US008282081B2

(12) United States Patent
Hwang et al.

(10) Patent No.: US 8,282,081 B2
(45) Date of Patent: Oct. 9, 2012

(54) GUIDING DEVICE OF HAULING ROPE FOR TOOLS IN BOREHOLE

(75) Inventors: Seho Hwang, Daejeon (KR); Hyoung Chan Kim, Daejeon (KR); In Hwa Park, Daejeon (KR); Jehyun Shin, Daejeon (KR)

(73) Assignee: Korea Institute of Geoscience and Mineral Resources, Daejeon (KR)

( * ) Notice: Subject to any disclaimer, the term of this patent is extended or adjusted under 35 U.S.C. 154(b) by 153 days.

(21) Appl. No.: 12/640,979

(22) Filed: Dec. 17, 2009

(65) Prior Publication Data

US 2010/0295006 A1 Nov. 25, 2010

(30) Foreign Application Priority Data

Dec. 22, 2008 (KR) ..... 10-2008-0131269

(51) Int. Cl.
*B66D 3/08* (2006.01)

(52) U.S. Cl. ..... 254/398; 254/393; 254/396

(58) Field of Classification Search ..... 254/285, 254/286, 287, 336, 338, 393, 394, 395, 396, 254/397, 398
See application file for complete search history.

(56) References Cited

U.S. PATENT DOCUMENTS

| | | | | |
|---|---|---|---|---|
| 3,589,642 | A * | 6/1971 | Blagg | 242/157.1 |
| 3,834,670 | A * | 9/1974 | Pityo | 254/338 |
| 3,871,621 | A * | 3/1975 | Jackson | 254/134.3 PA |
| 4,123,041 | A * | 10/1978 | Bucknall | 254/393 |
| 4,606,527 | A * | 8/1986 | Ziller et al. | 254/336 |
| 5,603,420 | A * | 2/1997 | Swanson | 212/274 |
| 6,592,101 | B2 * | 7/2003 | Vetesnik | 254/285 |
| 7,007,927 | B2 * | 3/2006 | Halas | 254/225 |
| 7,134,645 | B1 * | 11/2006 | Johnson et al. | 254/338 |

* cited by examiner

*Primary Examiner* — Emmanuel M Marcelo
(74) *Attorney, Agent, or Firm* — Sughrue Mion, PLLC

(57) ABSTRACT

Disclosed is a guiding device of a hauling rope, in more detail, a guiding device of a hauling rope that installed at the top of casing, which controls inserting/withdrawing a hauling rope connected with a Sonde, measuring instrument, which probes, observes, and examines an underground structure, geological features, or soil conditions within borehole.

8 Claims, 7 Drawing Sheets

GUIDING DEVICE OF HAULING ROPE FOR TOOLS IN BOREHOLE

CROSS-REFERENCE TO RELATED APPLICATIONS

This application claims the benefit of Korean Patent Application No. 10-2008-0131269, filed Dec. 22, 2008, in the Korean Intellectual Property Office, the disclosure of which is incorporated herein by reference.

BACKGROUND OF THE INVENTION

1. Field of the Invention

The present invention relates to a guiding device of a hauling rope, in more detail, a guiding device of a hauling rope that installed at the top of casing, which controls inserting/withdrawing a hauling rope connected with a Sonde, measuring instrument, which probes, observes, and examines an underground structure, geological features, or soil conditions etc. within borehole.

2. Description of the Related Art

In general, an operation of probing or measuring is performed at desired depth while inserting/withdrawing a measuring instrument, such as a Sonde, to acquire various information about the geological formation, such as an underground structure, geological features, or soil conditions and so on. The measuring instrument is connected to a hauling rope and the hauling rope allows the measuring instrument to be inserted/withdrawn into/out of a borehole by a winch and a guiding device of a hauling rope.

Since it is possible to insert a variety of examination instruments or experimental devices into a borehole using a guiding device of a hauling rope, not only it is possible to evaluate the geological structure and measure in situ physical properties of subsurface formation, but this can be used for the investigation of dam construction of a power plant or foundation examination of buildings.

The guiding device of a hauling rope described above, as shown in FIG. 1, is formed in a bar shape, which includes support members 101*a*, 101*b*, 101*c* of which ends cross each other and a roller 103 where a hauling rope 105 wound around a winch (not shown) is placed, on the joint of the support members 101*a*, 101*b*, 101*c*.

The guiding device of a hauling rope 100 is installed at the constant height of a borehole (not shown) drilled to observe or examine the borehole conditions and in situ physical properties, disposing the plurality of support members 101*a*, 101*b*, 101*c* at one side around the borehole (not shown) to cross each other, disposing the roller 103 on the joint of the support members, and then positioning the hauling rope 105 on the roller 103.

In this configuration, a measuring instrument, such as a Sonde 109, is connected to an end of the hauling rope 105 wound around the roller 103, that is, the end of the hauling rope 105 which is put into the borehole (not shown).

A worker or an observer on the ground observes or measures the conditions and in situ physical properties of subsurface formation by inserting the Sonde 109 connected to the end of the hauling rope 105 into the borehole (not shown) using a winch.

However, during the installation of the guiding device of a hauling rope as described above, there was a problem when a worker or a observer disposes the roller using the support members because it is difficult to fix and support the roller stably when the ground around a borehole is rough and different gradation or the height of casing is high.

Meanwhile, the borehole drilled to observe and measure the subsurface formation using the Sonde connected to the hauling rope may be clogged or collapsed, and the surface water may be flowed into a borehole.

In order to overcome the problems as described above, a method of preventing a borehole from being clogged or collapsed and inflow of surface water, by disposing a cylindrical borehole casing above the borehole; however, a technology for more easily observing and measuring the subsurface geological information by interlocking the borehole casing with the guiding device of a hauling rope has been required.

SUMMARY OF THE INVENTION

In order to overcome the problems, it is an object of the present invention to provide a guiding device of a hauling rope for tools in a borehole that can be easily attached to a borehole casing by a pressing member, can position a measuring instrument, such as a Sonde, connected to a hauling rope to the center of the borehole because the distance of a hauling rope guide body can be adjusted after being attached, and easily observing and measuring the subsurface geological information.

In order to accomplish the object of the present invention, a guiding device of a hauling rope for tools in a borehole that inserts/withdraws a hauling rope, which is equipped with a Sonde for observing and measuring the subsurface geological information at the end and wounded around a winch, into/out of a borehole where a borehole casing is disposed, includes: a hauling guide body that has a pair of rollers where the hauling rope is placed, and a moving member having fixing portions for fixing the pair of rollers at both ends; and a cradle that is attached to the borehole casing and includes a fixing member attached to the lower side of the moving member and a fastening unit attached to the lower side of the fixing member In this configuration, at least one or more distance adjusting holes are formed in a slot shape through one side of the moving member.

Further, the fixing member is fastened and fixed to the moving member by fixing bolts inserted in the distance adjusting holes and fixing nuts.

Further, the hauling guide body is moved forward/backward with respect to the cradle by tightening or loosening the fixing bolts and the fixing nuts.

In this configuration, the fastening unit includes a pressing member that moves forward/backward by being turned and a fastening plate that the end of the pressing member contact with, when moving forward.

Further, the lengths of the fixing portions of the hauling rope guide body are variable.

As described above, according to the present invention having the above configuration, since the cradle can be easily attached to the borehole casing by the pressing member, it is possible to observe and examine the subsurface geological information, even though the ground around a borehole is rough and different gradation or the height of casing is high. Further, since the distance can be adjusted while the hauling rope guide body where the hauling rope is placed moves forward/backward with respect to the cradle, it is possible to position the measuring device, such as a Sonde, which is connected to the hauling rope, to the center of the borehole regardless of the diameter of the borehole.

DETAILED DESCRIPTION OF THE PREFERRED EMBODIMENTS

A detailed exemplary embodiment of the present invention is described hereafter in detail with reference to the accompanying drawings. Further, the embodiment is provided as an example and does not limit the spirit of the present invention, and can be modified in various ways without departing from the scope of the present invention.

Figure 1:
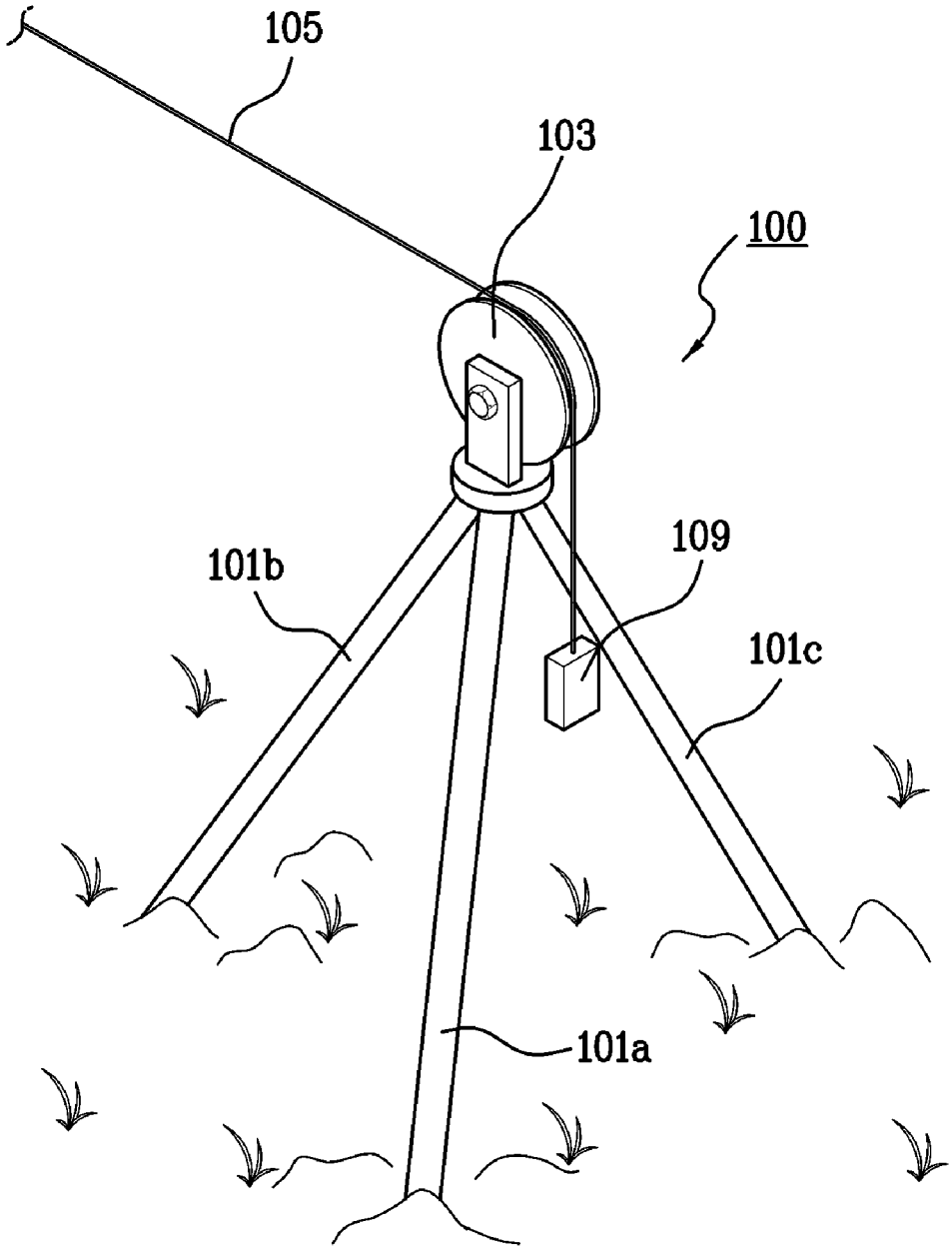
FIG. 1 is a perspective view schematically showing when a typical guiding device of a hauling rope is installed.
Figure 2:
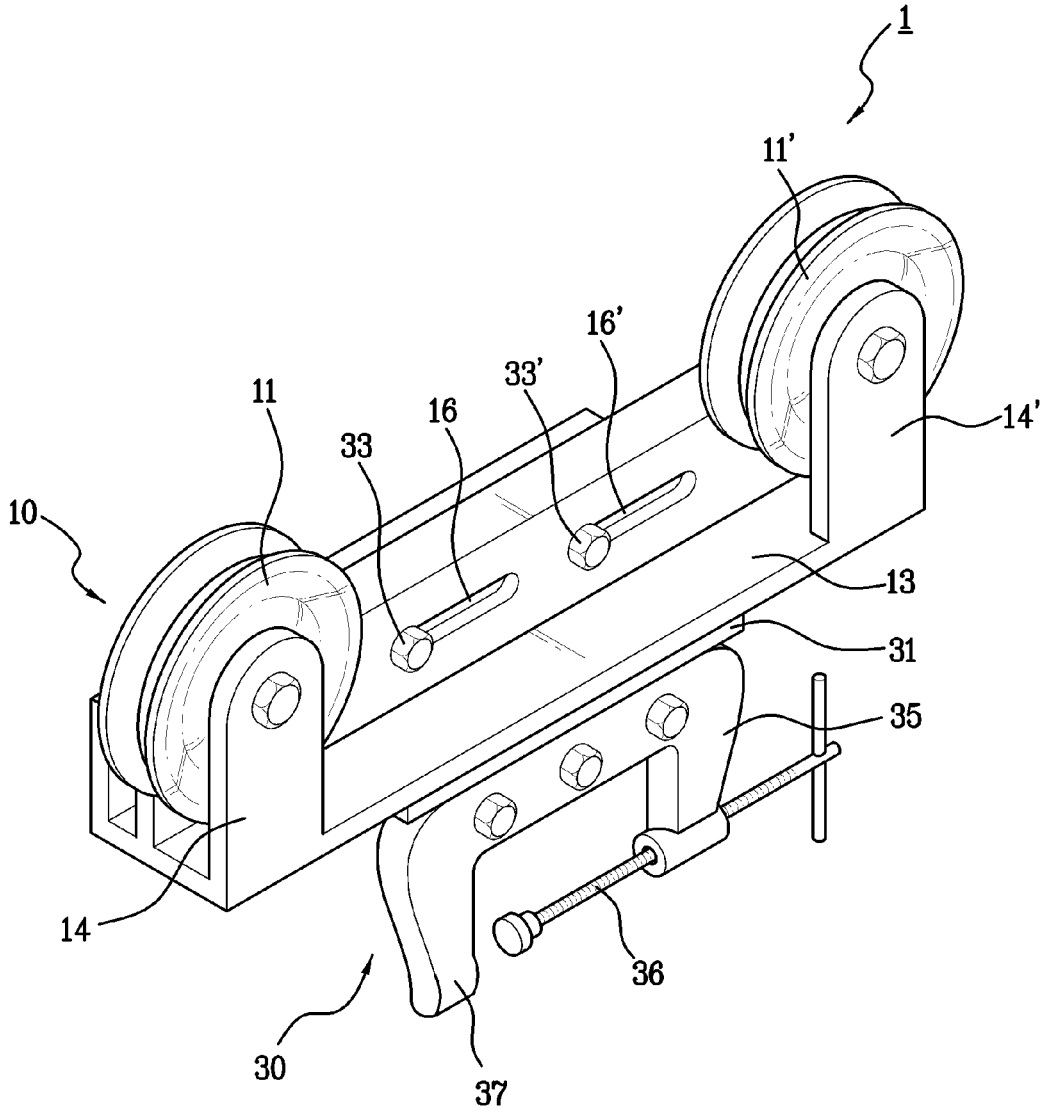
FIG. 2 is a front perspective view schematically showing a guiding device of a hauling rope for tools in a borehole according to the present invention.
Figure 3:
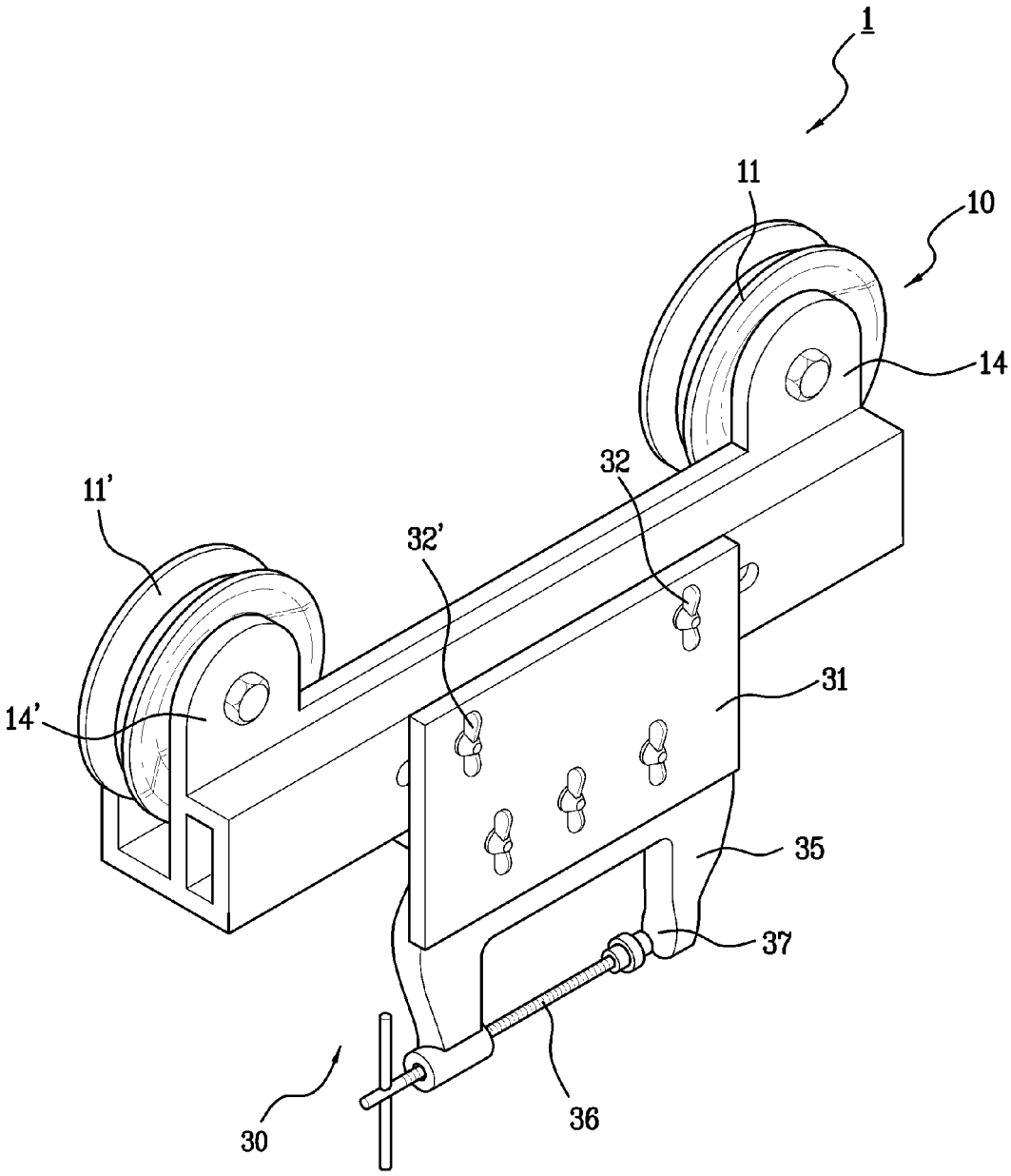
FIG. 3 is a rear perspective view schematically showing the guiding device of a hauling rope for tools in a borehole according to the present invention.
Figure 4:
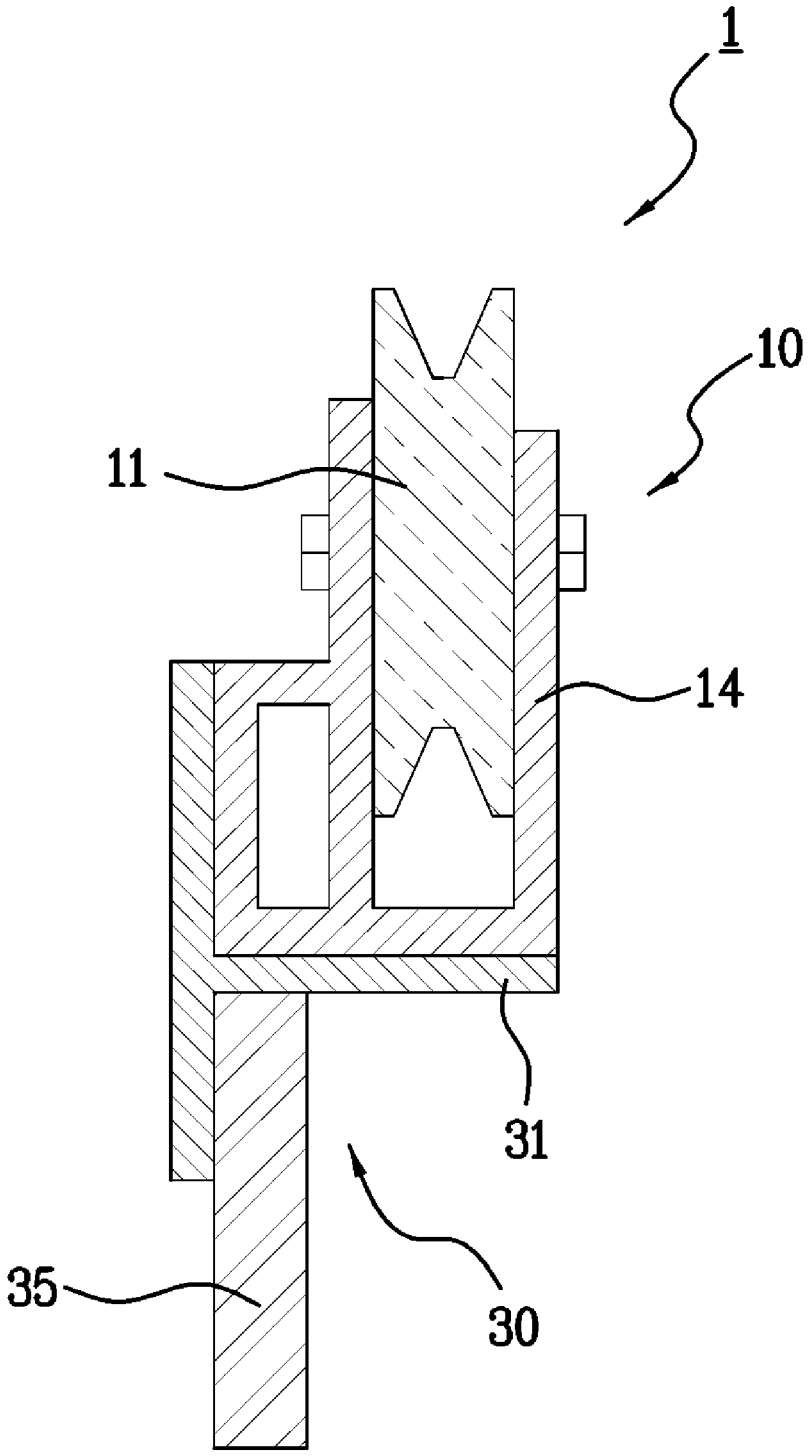
FIG. 4 is a side view schematically showing the guiding device of a hauling rope for tools in a borehole according to the present invention.
Figure 5:
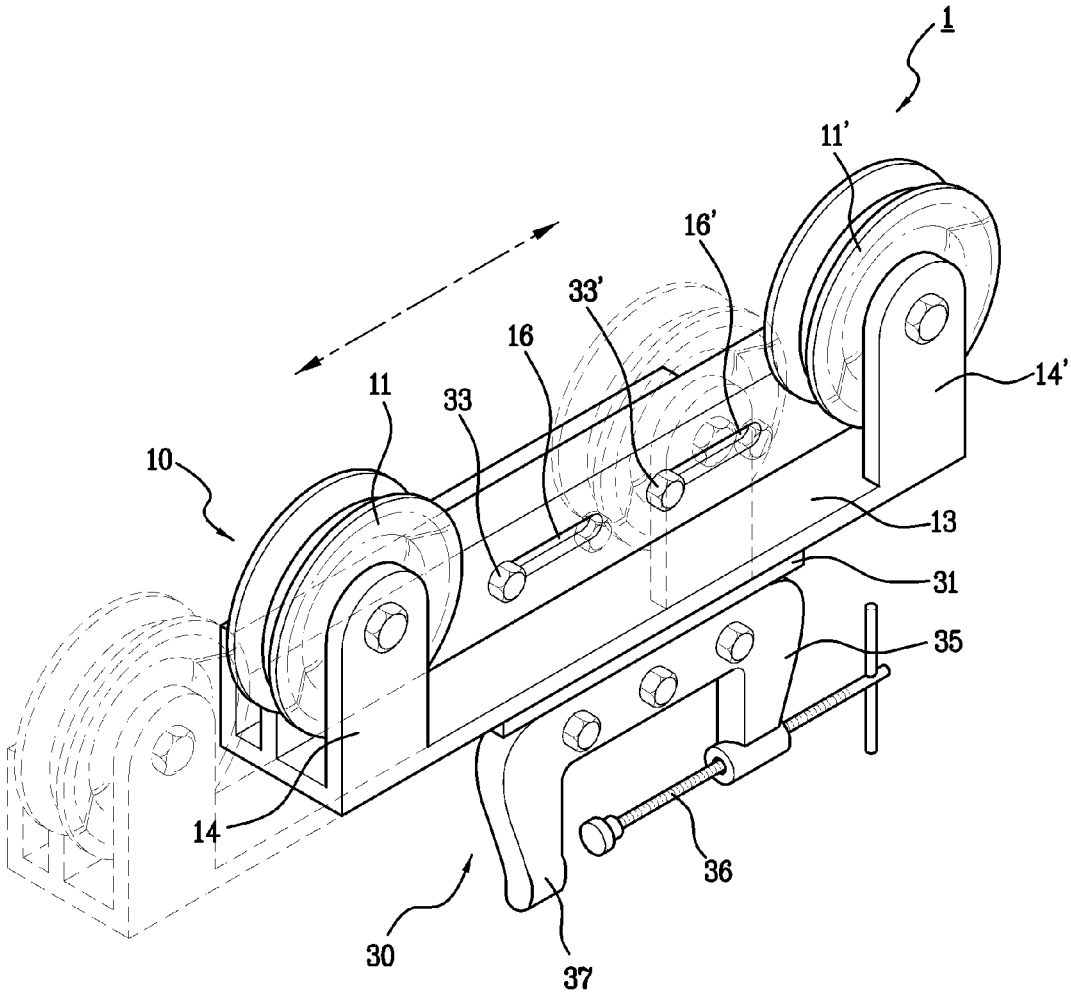
FIG. 5 is a perspective view illustrating the adjustment of a position of the guiding device of a hauling rope for tools in a borehole according to the present invention.
Figure 6:
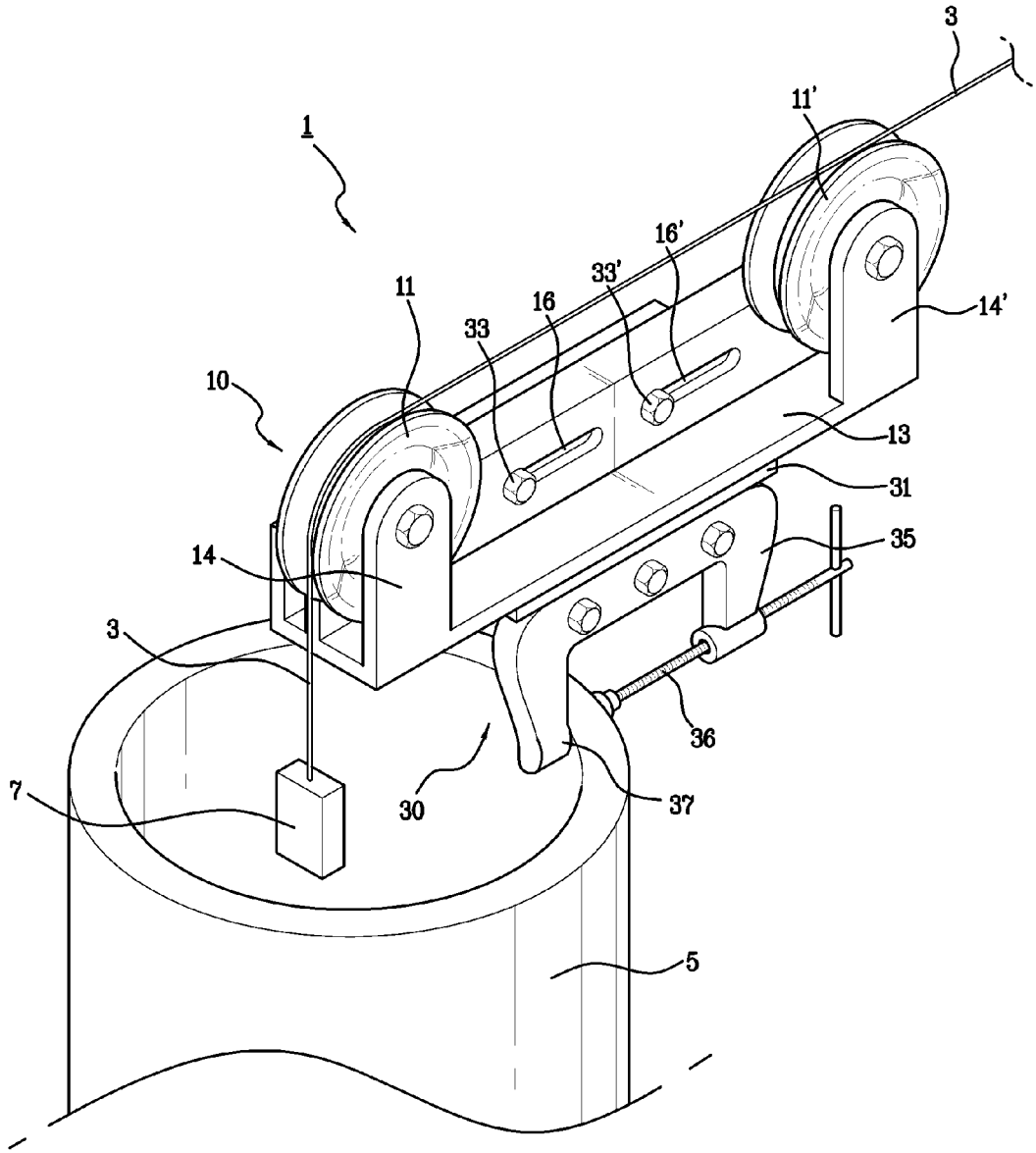
FIG. 6 is a perspective view schematically showing when the guiding device of a hauling rope for tools in a borehole according to the present invention is installed.

FIG. 2 is a front perspective view schematically showing a guiding device of a hauling rope for tools in a borehole according to the present invention, FIG. 3 is a rear perspective view schematically showing the guiding device of a hauling rope for tools in a borehole according to the present invention, FIG. 4 is a side view schematically showing the guiding device of a hauling rope for tools in a borehole according to the present invention, FIG. 5 is a perspective view illustrating the adjustment of a position of the guiding device of a hauling rope for tools in a borehole according to the present invention, and FIG. 6 is a perspective view schematically showing when the guiding device of a hauling rope for tools in a borehole according to the present invention is installed.

As shown in the figures, a guiding device of a hauling rope for tools in a borehole includes a hauling rope guide body 10 and a cradle 30.

The hauling rope guide body 10 includes a pair or rollers 11, 11' for inserting/withdrawing a hauling rope 3 wound around a winch (not shown) into/out of the ground, an L-shaped moving member 13 having fixing portions 14, 14' for fixing the pair or rollers 11, 11' at both ends, and one or more distance adjusting holes 16, 16' formed in a slot shape through one side of the moving member 13.

The rollers 11, 11' and the distance adjusting holes 16, 16' are arranged in the longitudinal direction of the moving member 13.

With the structure and shape as described above, the hauling guide body 10 can easily insert/withdraw the hauling rope 3 wound around the winch into/out of the ground, and a worker or an observer monitors conditions inside the ground through a Sonde 7, which is a measuring instrument connected to the end of the hauling rope 3.

It is preferable that the hauling rope 3 is provided with an electricity or signal transmitting/receiving cable (not shown) in order for the worker or the observer to monitor conditions inside the ground through the Sonde 7.

The cradle 30 is provided to be attached to a cylindrical borehole casing 5 disposed at the inlet of the borehole bored by a drilling rig (not shown) to prevent the borehole from being clogged, when the soil caves in or collapses.

Accordingly, the cradle 30 includes a fixing member 31 formed in a T-shape to be attached to the lower side of the moving member 13 of the guiding hauling body 10 and a fastening unit 35 attached to the lower side of the fixing member 31.

The fixing member 31 is fastened and fixed to the moving member 13 of the hauling rope body 10 by fixing bolts 33, 33' and the fixing bolts 33, 33' are fixed in the distance adjusting holes 16, 16' formed in the longitudinal direction through the moving member 13 by fixing nuts 32, 32'.

The moving member 13 can be moved forward/backward from the fixing member 31 and fixed after being moved forward/backward, by tightening or loosening the fixing bolts 33, 33'.

That is, the cradle 30 can be moved forward/backward with respect to the hauling rope body 10 by moving the moving member 13 forward/backward on the fixing member 31 after partially loosening the fixing bolts 33, 33' inserted in the distance adjusting holes 16, 16' from the fixing nuts 32, 32', stopping the moving member 13 at a predetermined position while moving it forward/backward, and then moving and fixing the moving member 13 from the fixing member 31 by tightening the fixing bolts 33, 33' in the distance adjusting holes 16, 16'.

The fastening unit 35 is disposed beneath the fixing member 31, and includes a pressing member 36 that moves forward/backward while turning and a fastening plate 37 that the end of the pressing member 36 contacts with when moving forward.

Installation process and operational process of the guiding device of a hauling rope for tools in a borehole 1 according to the present invention is described hereafter with reference to FIG. 6.

First, a hole, such as a borehole (not shown), is formed by a drilling rig at a predetermined location on the ground to observe and examine the subsurface geological information.

After the borehole is drilled through the ground to observe and examine underground conditions such as geological structure and in situ physical properties, a cylindrical borehole casing 5 for preventing the borehole from being clogged or collapsed, and inflow of surface water at the top of borehole.

After the borehole casing 5 is installed above the inlet part of the borehole as described above, the guiding device of a hauling rope for tools in a borehole 1 according to the present invention is attached to the edge of the borehole casing 5.

That is, the guiding device of a hauling rope for tools in a borehole 1 is attached to the borehole casing 5 by positioning the pressing member 36 and the fastening plate 37 of the fastening unit 35 of the guiding device of a hauling rope for tools in a borehole 1 at a predetermined distance, positioning the fastening unit 35 to the edge of the borehole casing 5, and then turning the pressing member 36 of the fastening unit 35 to move forward to the fastening plate 37.

Next, the hauling rope 3 wound around the winch (not shown) on the ground is placed on the pair of rollers 11, 11' arranged in the longitudinal direction in the guiding device of a hauling rope for tools in a borehole 1.

The Sonde 7 that is a measuring instrument for observing and examining the subsurface geological information is connected to the end of the hauling rope 3 wound around the winch and inserted inside the borehole through the borehole casing 5.

On the other hand, in order to position the Sonde 7 at the end of the hauling rope 3 placed on the guiding device of a hauling rope for tools in a borehole 1 to the center of the borehole casing 5 when attaching the guiding device of a hauling rope for tools in a 1 to the borehole casing 5, the Sonde 7 connected to the hauling rope 3 that is inserted into the borehole by the pair of rollers 11, 11' is positioned at the center of the borehole casing 5, by combining and fixing the hauling rope guide body 10 and the cradle 30, loosening the fixing bolts 33, 33' in the distance adjusting holes 16, 16' of the moving member 13 of the hauling guide body 10 from the fixing nuts 32, 32', and then moving the hauling rope guide body 10 forward/backward in the longitudinal direction of the cradle 30.

As described above, since it is possible to adjust the position of the hauling rope body 10 with respect to the cradle 30, it is possible to variously change the position of the Sonde 7 connected to the end of the hauling rope 3 with respect to the borehole casing 5.

After attaching the guiding device of a hauling rope for tools in a borehole 1 to the borehole casing 5 and placing the hauling rope 3 with the Sonde 7 to the guiding device of a hauling rope for tools in a borehole 1 as described above, a worker or an observer on the ground observes or examines the subsurface geological information by operating the winch such that the Sonde 7 connected to the end of the hauling rope 3 is inserted in the borehole.

The conditions inside the borehole observed and examined by the Sonde 7 are monitored and recorded by the measurement console connected with a cable disposed in the hauling rope 3 or specifically provided.

Figure 7:
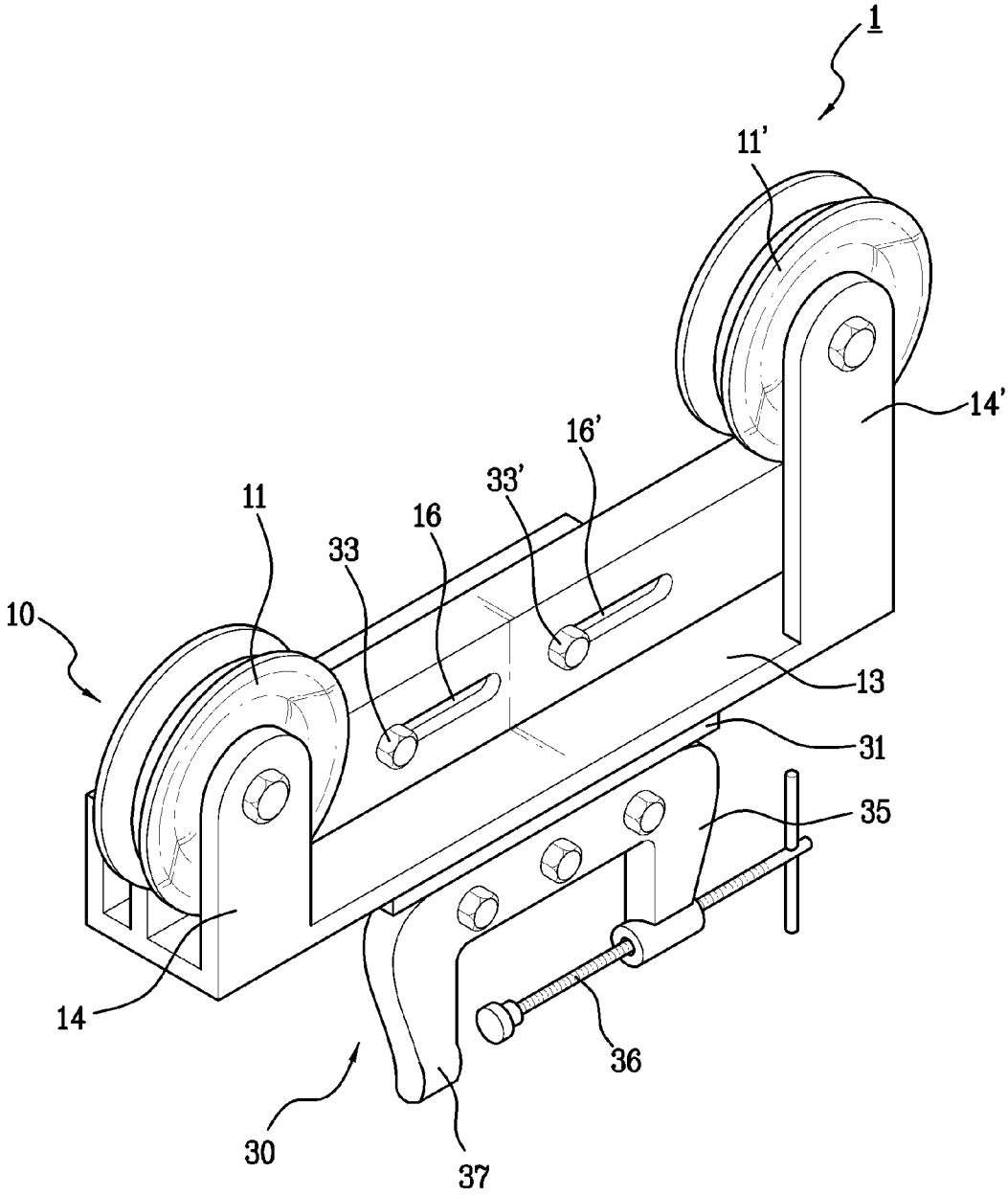
FIG. 7 is a perspective view schematically showing another embodiment of a guiding device of a hauling rope for tools in a borehole according to the present invention.

On the other hand, as shown in FIG. 7, it may be preferable to change the distance of any one fixing portion 14' of the fixing portions 14, 14' at both ends of the hauling rope guide body 10 of the guiding device of a hauling rope for tools in a borehole 1 while changing the positions of the rollers 11, 11' such that the hauling rope 3 wound around the winch is inclined to easily insert/withdraw the Sonde 7 into/out of the borehole.

Although the present invention was described with reference to specific embodiments, it should be understood that the present invention can be easily changed and modified in various ways by those skilled in the art, without departing from the spirit and scope of the present invention.

What is claimed is:

1. A guiding device of a hauling rope for inserting and/or withdrawing a tool in a borehole, wherein the tool is to be coupled to an end of the hauling rope and observes and/or measures the subsurface geological information inside the borehole, the guiding device comprising:

a hauling guide body that has a pair of rollers where the hauling rope is placed, and a moving member having two distant fixing portions each located at one side of the moving member, said fixing portions each holding the one of the rollers; and a cradle attached to the moving member by way of a fixing member, at the side opposite to the side where the rollers are fixed, said cradle comprising a fastening unit for fastening the guiding device to an external object.

2. The guiding device of a hauling rope according to claim 1, wherein the moving member comprises a side wall and one or more distance adjusting holes formed in a slot shape along the side wall.

3. The guiding device of a hauling rope according to claim 2, wherein the fixing member is fastened and fixed to the moving member by fixing bolts inserted in the distance adjusting holes and fixing nuts.

4. The guiding device of a hauling rope according to claim 3, wherein the hauling guide body is moveable forward/backward with respect to the cradle by moving the fixing bolts and the fixing nuts along the distance adjusting hole.

5. The guiding device of a hauling rope according to claim 2, wherein the fastening unit includes a fastening plate and a pressing member with an external thread, wherein the pressing member is engaged with the fastening unit and is moveable toward and away from the fastening plate to adjust the distance between the fastening plate and a tip of the pressing member by rotating clockwise or counterclockwise the pressing member.

6. The guiding device of a hauling rope according to claim 2, wherein the fixing member is fastened and fixed to the moving member by way of an assembly of a bolt inserted in the distance adjusting hole and a nut.

7. The guiding device of a hauling rope according to claim 1, wherein the rollers have a same or different diameters from each other, and wherein the fixing portions of the hauling rope guide body have same or different heights from each other to accommodate each of the rollers.

8. The guiding device of a hauling rope according to claim 1, wherein the external object is a borehole casing.

* * * * *